US005123311A

United States Patent [19]

Dymek

[11] Patent Number: 5,123,311

[45] Date of Patent: Jun. 23, 1992

[54] FLEXIBLE AXIAL COMPENSATING DRIVER

[75] Inventor: Andrew C. Dymek, Richboro, Pa.

[73] Assignee: Ford Motor Company, Dearborn, Mich.

[21] Appl. No.: 726,411

[22] Filed: Jul. 5, 1991

[51] Int. Cl.[5] ..... B25B 23/16

[52] U.S. Cl. ..... 81/177.6; 464/57; 403/229; 403/287

[58] Field of Search ..... 81/177.6; 464/57, 58, 464/60; 403/229, 287, 291

[56] References Cited

U.S. PATENT DOCUMENTS

| | | | |
|---|---|---|---|
| 873,363 | 12/1907 | Foss . | |
| 1,472,782 | 11/1923 | Barber | 464/57 |
| 2,669,148 | 2/1954 | Falk | 81/124.1 |
| 2,735,325 | 2/1956 | Rudd, Sr. | 81/71 |
| 2,747,384 | 5/1956 | Beam | 464/57 |
| 2,817,985 | 12/1957 | Capelle | 81/3 |
| 2,880,435 | 4/1959 | Deutsch et al. | 464/58 |
| 2,917,910 | 12/1959 | Herbenar | 464/60 |
| 3,118,159 | 1/1964 | Kollmann | 464/57 |
| 3,320,837 | 5/1967 | Alm | 81/185 |
| 3,397,420 | 8/1968 | Schneider | 464/57 |
| 3,779,105 | 12/1973 | Triplett et al. | 81/121 R |
| 3,892,149 | 7/1975 | Rydberg | 81/71 |

*Primary Examiner*—J. J. Hartman

*Attorney, Agent, or Firm*—Daniel M. Stock; Roger L. May

[57] ABSTRACT

A flexible, axial compensating, rotary driver-type tool bit for adjusting fasteners or adjustment screws for use with a driver motor or other automatically driven system, the driver having flexible couplings between a base member, a driver member and a collar. The driver capable of both axial adjustment and lateral adjustment in response to the relative position of the fasteners or adjustment screws. The driver member moves axially within a collar relative to the base member within limits established by a limiting pin extending from the driver member and cooperating with an elongated slot in the collar and by the space between the base member and the driver member. The driver member and the collar also adjust laterally relative to the base as permitted by a spring connecting the collar and the base member.

17 Claims, 1 Drawing Sheet

FLEXIBLE AXIAL COMPENSATING DRIVER

TECHNICAL FIELD

This invention relates to tools for rotationally adjusting fasteners and the like, and in particular, to a composite driving rotary tool for use with automated potentiometer adjusting systems and capable of compensating for axial misalignment and differences in distance between the drive motor and the potentiometer being adjusted.

Background Art

There is believed to be a need in the industry for a rotary tool which can be driven by a fixed position driver motor or other driving mechanism which will accommodate within fixed limits (i) differences in the distance from the drive motor and the fastener or other component to be driven or adjusted and (ii) the possibility of the axis of the drive motor being either off-center or askew of the axis of the fastener or other component being driven or adjusted.

For example, in the field of adjusting potentiometers to a printed circuit board, as with the manufacture of automotive radios, there is a need for an automated system, including one that can accommodate adjusting at the same time either a single component or a plurality of components. Heretofore, the potentiometers have been adjusted on the board manually, requiring adjustment of the potentiometers on a piece-by-piece basis. This requirement of manual adjustment necessitates an undesirable amount of time, effort and expense to ensure that each item is independently adjusted to the proper position.

The present invention is capable of both axial and lateral adjustment to compensate for axial misalignments and depth variations of the fasteners or adjustment screws. Automation of this process to simultaneously adjust a plurality of such fasteners or adjustment screws is possible by connecting a driver mechanism to a stepper motor.

SUMMARY OF THE INVENTION

The present invention is a flexible axial compensating driver for adjusting fasteners or adjustment screws. A base member is flexibly drivably coupled with both a collar and a driver member by means of a plurality of springs interposed therebetween enabling compensation for axial misalignment and differences in depth between the drive motor and the component being adjusted or secured.

It is an object of the present to provide an inexpensive method of adjusting a plurality of fasteners or adjustment screws simultaneously.

Another object of the present invention is to provide a method of automating the adjustment of fasteners or adjustment screws.

A further object of the present invention is to provide a driver capable of lateral adjustment for the purpose of adjusting a fastener or adjustment screw when the axis of the driven member is either off center but parallel to the driver and/or askew to the axis of the driver.

Still another object of the present invention is to provide an axially adjustable driver to accommodate fasteners or adjustment screws of varying heights and thereby accommodating differences in axial length between a drive chuck and the fasteners or adjustment screws being adjusted or driven A specific object of the present invention is to provide a driver mechanism to compensate for axial misalignments and depth variations between a driving member and a driven member. The driver has a base having an attachment means for attaching the driver to a chuck. A collar flexibly coupled to the base has a hollow center portion and defines an elongated slot. A driver member is inserted into the center portion of the collar in a sliding fit thereto and in flexible coupling to the base. The driver member also has an aperture. A pin within the aperture secures the driver member to the collar and provides a limiting means in cooperation with the slot for limiting axial movement of the driver member relative to the collar. A first spring flexibly couples the base to the collar, thereby biasing the collar away from the base. The first spring provides a lateral adjustment means. A second spring flexibly couples the base to the driver member, thereby biasing the driven member from the base. The second spring cooperates with the limiting means to provide an axial adjustment means.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
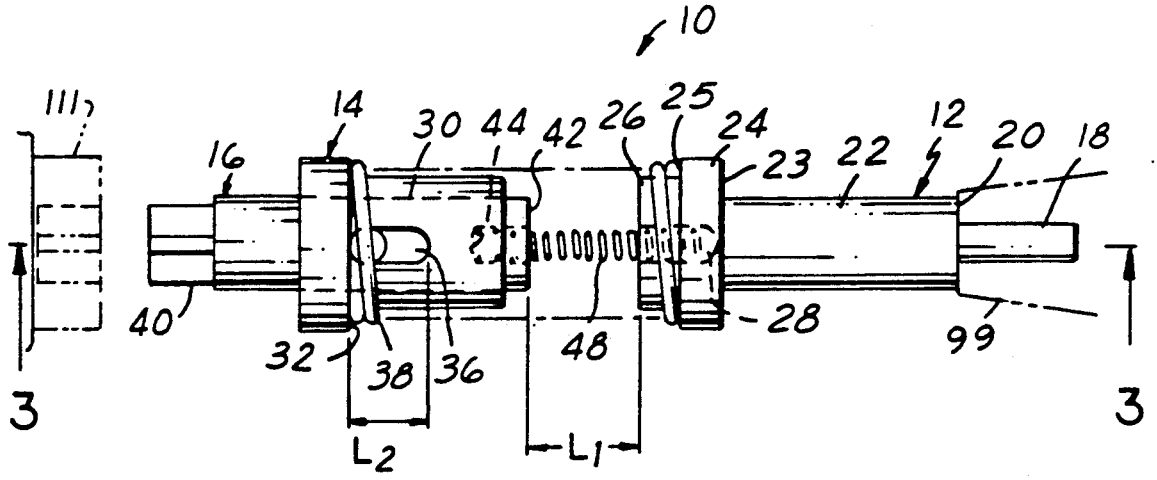
FIG. 1 is an elevational view of the driver showing the internal elements of the present invention.
Figure 2:
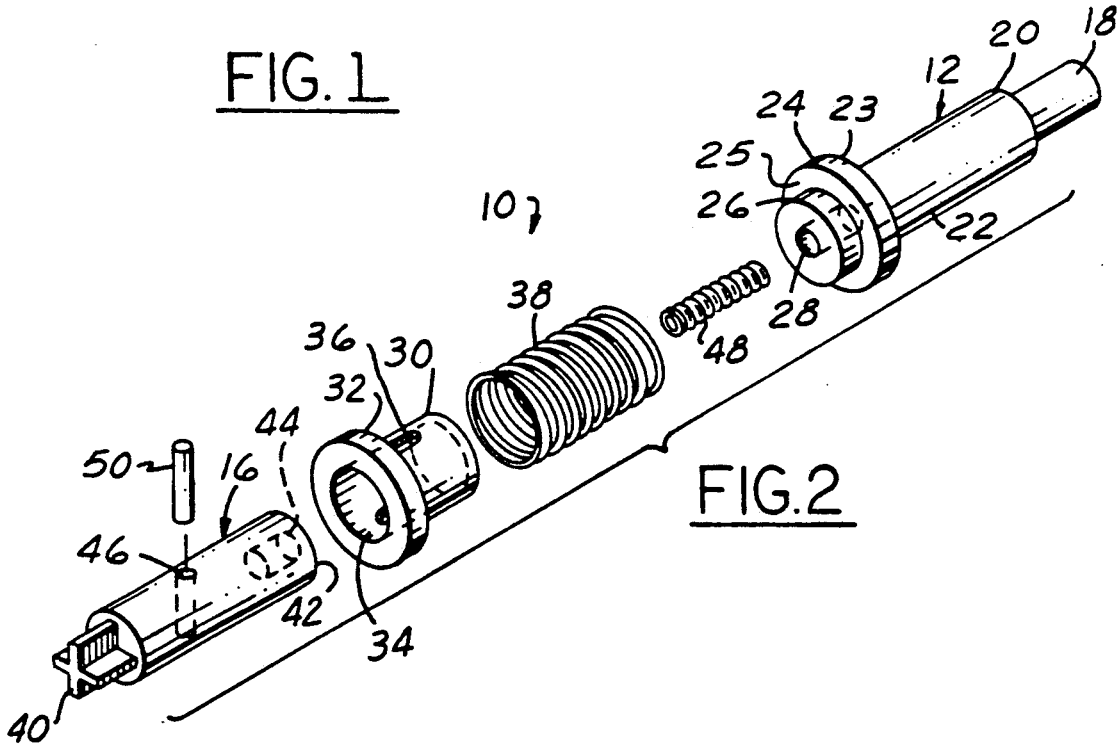
FIG. 2 is an exploded view of the driver in accordance with the present invention.

Referring to the drawings, the driver mechanism of the present invention, generally indicated at 10, includes a base, a collar, and a driver member, generally indicated at 12, 14 and 16, respectively.

The base 12 is generally cylindrical in shape and is formed of four concentric cylinders in axial alignment. A first concentric cylinder 18 extends laterally from one end. A first shoulder 20 is formed where the first concentric cylinder 18 meets a second concentric cylinder 22. The second concentric cylinder 22 has a larger diameter than the first concentric cylinder 18. The first concentric cylinder 18 is adapted to be secured to a chuck 99 (shown in phantom line) of a driver motor (not shown). The chuck 99 seats against the first shoulder 20 of the driver mechanism 10. A third concentric cylinder 24 is interposed between a fourth concentric cylinder 26 constituting a hub which extends longitudinally from the base 12 at an end opposite the first concentric cylinder 18 and the second concentric cylinder 22. The third concentric cylinder 24 is larger in diameter than both the second concentric cylinder 22 and the fourth concentric cylinder 26 as to form a second shoulder 23 and a third shoulder 25. The second shoulder is formed where the second concentric cylinder 22 abuts the third concentric cylinder 24 and the third shoulder 25 is formed where the fourth concentric cylinder 26 abuts the third concentric cylinder 24. The fourth concentric cylinder 26 is larger in diameter than the second concentric cylinder 22 and smaller in diameter than the third concentric cylinder 24.

A cylindrical cavity 28 is centrally located in the fourth concentric cylinder 26.

The collar 14 is also cylindrical and has an elongated body 30 extending perpendicular and laterally to a shoulder 32. The outer diameter of elongated body 30 is equal to that of the opposing concentric cylinder 26. The collar has a hollow center 34 and a pair of diametrically opposed elongated slots 36 extending axially in the wall of the body 30. The first spring 38 has an internal diameter which is slightly smaller than the body 30 and the fourth concentric cylinder 26. One end 37 of the first spring 38 is force-fitted over the body 30 of the collar 14 until it abuts shoulder 32. Another end 39 of the first spring 38 is force-fitted over the fourth concentric cylinder 26 of the base 12 until it abuts the third shoulder 25. Alternatively, epoxy may be utilized for additional anchoring of the first spring 38. The force-fitting of the first spring 38, with or without epoxy, provides a destructive slip clutch which prohibits over-torquing of an adjusted member 111 by the driver mechanism 10 by causing the first spring 38 to rotate on the body 30 and the fourth concentric cylinder 26 (breaking the epoxy bond, if expoyed) rather than over adjusting the adjusted member 111. Once assembled, the first spring 38 flexibly, drivably couples the base 12 and the collar 14. The flexibility of this coupling biases the collar 14 from the base 12. Rather than being manufactured to the proper size, the first spring 38 is cut down from a larger spring (not shown) to the desired size. The result is that the ends of the first spring 38 are not ground—as in a finished spring. The rough ends of the first spring 38 when force-fit onto the fourth concentric cylinder 26 and the elongated body 30 results in a skewed longitudinal axis 2 cylinder to the 26 longitudinal axis y the first spring 38 which imparts an eccentric rotation to the driver mechanism 10 which causes tool end 40 to hunt in an orbital path for the adjusted member 111. This improves the picking up or centering of the driver member 16 onto the adjusted member 111.

The driver member 16 is cylindrical and has a tool end 40 and a cavity end 42. The tool end 40 is configured to correspond to the requirements of the head of the adjusted member 111, represented in phantom line. In this particular embodiment, the tool end 40 is configured to be the male end of a phillips driver. A cavity 44 is generally coaxially centrally located in the cavity end 42. The cavity 44 is the mirror image of the cavity 28 located in the base 12. An aperture 46 extends completely through driver member 16 in a direction transverse to the driver member's 16 longitudinal axis. The collar 14 is seated on the driver member 16 in a close sliding fit and secured thereto by inserting a pin 50 into both the elongated slots 36 and the aperture 46.

A second spring 48 is press-fitted into the cavity 28 in the base 12 and the cavity 44 in the driver member 16, thereby to flexibly couple the base 12 and the driver member 16. Thus, the second spring 48 is concentrically located within the first spring 38. The second spring 48 as assembled is maintained under slight compression thereby biasing the driver member 16 from the base 12 and maintaining it in engagement with collar 14. The assembled length of the second spring 48 determines distance $L_1$ between the base 12 and the driver member 16. The second spring 48, in cooperation with the pin 50, slidably engaged in the elongated slots 36, provides a limiting means for limiting the axial movement of the driver member 16 relative to the collar 14. As the driver member 16 reciprocates relative to the collar 14 and the base 12 in response to the relative height of the adjusted member 111 and the distance between it and the chuck 99, the pin 50 travels with the driver member 16 in the slots 36 until it abuts one end or the other of the slots 36 thereby limiting the relative axial travel of the driver member 16 This travel distance is represented by $L_2$. This preselected travel distance can also be set as the distance $L_1$. The limiting factor as the driver member 16 travels in a direction toward the base 12 can be the cavity end 42 of the driver member 16 coming into contact with the fourth concentric cylinder 26 of the base 12 thereby preventing any further travel of the driver member 16 in that direction. Thus, the travel of the driver member in the direction of the base 12 is limited by either the pin 50 engaging the end of the slot 36 or abutting the fourth concentric cylinder 26 whichever distance of travel is smaller It will also be noted that pin 50 within the slot 36 precludes any relative rotation between the driver member 16 and collar 14.

The combination of the first spring 38 and the second spring 48 enables the driver mechanism 10 to be laterally adjustable to accommodate axially misaligned adjusted members 111 and compensate for differences in depth between the driver motor 99 and the member 111 being adjusted The combination of the first spring 38 and the second spring 48 also serves to maintain the driver mechanism 10 as a unit by joining the base 12 to the collar 14 which in turn is fixed to the driver member 16.

Figure 3:
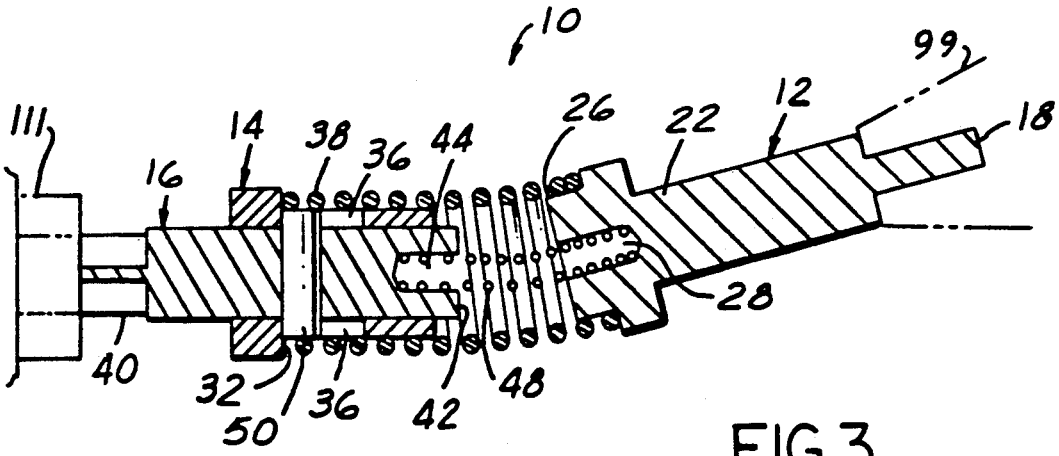
FIG. 3 is a cross-sectional elevational view similar to that shown in FIG. 1, showing the driver in engagement with the fastener or adjustment screw, resulting in partial lateral adjustment and axial adjustment of the driver in accordance with the present invention.

In operation, the driver motor and chuck 99 is activated slowly eccentrically turning or spinning the driver mechanism 10 as the driver mechanism 10 is moved toward the adjusted member 111. In this position, the driver member 16 is extended as far from the base 12 as possible by the second spring 48 pushing the driver member 16 away from the base 12. This movement of the driver member 16 is limited by the pin 50 engaging a forward edge of the slot 36 which abuts the shoulder 32. The tool end 40 of the driver member 16 continues to spin as it engages the adjusted member Assume for purposes of this embodiment that there is only one driver mechanism 10 being operated. As contact with the adjusted member 111 is made, the driver member 16 and the collar 14 will eccentrically pivot about a fulcrum formed by the base 12 if necessary to locate the adjusted member 111. Thus, the axis of the adjusted member 111 and collar 14 may be askew at a slight angle from that of driver mechanism 10, as shown in FIG. 3. The lateral adjustment consists of the first spring 38 compressing along one side enabling lateral slidable connection of the driver mechanism 10 and the adjusted member 111 as the driver mechanism 10 is spinningly lowered onto the adjusted member 111 enabling the tool end 40 to properly align and seat on the adjusted member 111. Once the tool end 40 of the driver member 16 is properly seated on the adjusted member 111, the driver mechanism 10 then adjusts the adjusted member 111 the amount desired.

While the best mode for carrying out the invention has been described in detail, those familiar with the art to which this invention relates will recognize various alternative designs and embodiments for practicing the invention as defined by the following claims.

I claim:

1. A driver mechanism to compensate for axial misalignments and depth variations between a driving member and a driven member, the driver mechanism comprising:

a base member having a longitudinal axis and an attachment means for attaching the driver mechanism to a chuck;

a collar flexibly coupled to the base and having a longitudinal axis, the collar having a hollow center portion extending along the collar axis, an open end, and an outer wall portion, and an elongated slot within the outer wall portion and extending along the collar axis;

a driver member projecting from the open end and slidably received within the center portion of the collar along the collar axis, and having an aperture therein extending transversely of the collar axis;

a pin fitted within the aperture and projecting into the elongated slot, thereby securing the driver member to the collar and providing a limiting means in cooperation with the slot for limiting travel in the direction of the collar axis and rotation of the driver member relative to the collar;

a first compression spring flexibly drivably coupling the base member to the collar and biasing the collar from the base member to provide a space therebetween;

a second compression spring flexibly coupling the base member to the drive member and biasing the driver member away from the base member to provide a space therebetween;

the first spring and the second spring cooperating with one another to provide lateral adjustment means for allowing the axis of the base member to be askew of the axis of the collar thereby accommodating any limited axial misalignment of a driving member and a driven member during driving engagement of each such member; and the first spring and the second spring cooperating with one another and the limiting means for providing an axial adjustment means for assuring driving engagement of the driver mechanism with a driven member throughout the length of said elongated slot.

2. The driver mechanism of claim 1 wherein the base member further includes a generally cylindrical body having a hub located at an end and a shoulder interposed between the hub and the body of the base member, and a closed-end cavity open to the collar and generally centrally located in both the hub and the shoulder for partially housing the second spring.

3. The driver mechanism of claim 1 wherein the driver member further includes a tool end, tooled to mate with the driven member, and an attachment end having a centrally located cavity and cooperating with the cavity located in the base member for partially housing the second spring under tension in flexible coupling relationship with the base member, the second spring thereby biasing the driver member from the base member.

4. The driver mechanism of claim 1 wherein the second spring is centrally located and contained within the first spring.

5. The driver mechanism of claim 1 wherein the collar further includes a shoulder and a body extending longitudinally therefrom, the first spring being located at one end on the base member body and abutting the base shoulder, and being located at the other end on the collar body and abutting the collar shoulder.

6. The driver mechanism of claim 1 wherein the pin is press-fitted into the aperture of the driver member and extends within the slot on the collar radially of the collar axis thereby limiting movement of the driver member to the length of travel of the pin within the slot on the collar or the space between the driver mechanism and the base member, whichever is less.

7. The driver mechanism of claim 1 wherein the first spring is press-fitted onto the elongated body of the collar and press-fitted onto the hub of the base member thereby securing the base member, collar and driver member as a unit while allowing lateral adjustment of the driver to engage the driven member which may be axially misaligned and allowing axial displacement of the base member and driver member toward one another.

8. The driver mechanism of claim 1 wherein the second spring is press-fitted at one end into the cavity located in the base member and at the other end into the cavity located in the driver member such that the second spring biases the driver member relative to the base member, the second spring allowing height adjustment of the driver member by compressively yielding within the collar relative to the base member to accommodate the varying heights of the driven member.

9. A driver mechanism to compensate for axial misalignment and depth variation between the driver mechanism and a workpiece, the driver mechanism comprising:

a base member having a longitudinal axis and having adapted to be rotatably coupled to a driving member;

a driver member having a longitudinal axis and spaced from the base member rotatably engageable with the workpiece;

a collar, one of said base members and said driver member and the collar being concentrically located with the other of said one member and the collar and in sliding engagement with said one member;

the collar and the one member including interengaging limit means for precluding relative rotation between the collar and the one member and for permitting reciprocation of the one member relative to the collar over a preselected fixed axial limit along the longitudinal axis of the one member, the members being axially spaced from one another a preselected distance no less than the preselected fixed axial limit;

a first compression spring means bridging the space between said members and maintaining the axial distance between the members at the preselected distance when in an uncompressed state, the first spring means flexibly drivably coupling the driver member with the base member;

a second compression spring means bridging the space between said members and biasing the collar and the one member against the limit means;

whereby the first and second spring means may flex radially and axially within the limits of the preselected fixed axial limit of said limit means and the space between the members in response respectively to the axial misalignments and the depth variations between the workpiece being driven and the driver mechanism.

10. A driver mechanism to compensate for axial misalignment and depth variation between a driving member and a workpiece, the driver mechanism comprising:

a base member;

a driver member spaced from the base member;

a pin radially projecting from the driver member;

a collar surrounding the driver member and relatively movable thereon, the collar having a slot receiving the pin for limiting the relative movement of the collar on the driver member;

a first compression spring bridging the space between the members and axially maintaining a preselected distance between the members when in an uncompressed state, the first spring flexibly drivably connecting the collar and the base member and biasing the collar away from the base member;

a second compression spring bridging the space between the members and biasing the collar member and the base member against the limit means;

whereby the first and second spring may flex radially and axially within the limits of the preselected fixed axial limit of the limit means and the space between the members in response to the axial misalignment and the depth variations between the workpiece being driven and the driving mechanism.

11. The driver mechanism of claim 10 wherein the base member further includes a generally cylindrical body having a hub located at an end and a shoulder interposed between the hub and the body of the base member, and a closed-end cavity open to the collar and generally centrally located in both the hub and the shoulder for partially housing the second spring.

12. The driver mechanism of claim 10 wherein the driver member further includes a tool end, tooled to mate with the driven member, and an attachment end having a centrally located cavity and cooperating with the cavity located in the base member for partially housing the second spring under tension in flexible coupling relationship with the base member, the second spring thereby biasing the driver member from the base member.

13. The driver mechanism of claim 10 wherein the second spring is centrally located and contained within the first spring.

14. The driver mechanism of claim 10 wherein the collar further includes a shoulder and a body extending longitudinally therefrom, the first spring being located at one end thereof on the base member body and abutting the base shoulder, and being located at the other end thereof on the collar body and abutting the collar shoulder 15. The driver mechanism of claim 10 wherein the pin is press-fitted into the aperture of the driver member and extends radially within the slot on the collar thereby limiting movement of the driver member to the length of travel of the pin within the slot on the collar or the space between the driver member and the base member, whichever is less.

16. The driver mechanism of claim 10 wherein the first spring is press-fitted at one end onto the elongated body of the collar and at the other end onto the hub of the base member thereby securing the base member, collar and driver member as a unit while allowing lateral adjustment of the driver to engage the driven member which may be axially misaligned and allowing axial displacement of the base member and driver member toward one another.

17. The driver mechanism of claim 10 wherein the second spring is press-fitted at one end into the cavity located in the base member and at the other end into the cavity located in the driver member such that the second spring biases the driver member relative to the base member, the second spring allowing height adjustment of the driver member by compressively yielding within the collar relative to the base member to accommodate the varying heights of the drive member.

* * * * *

UNITED STATES PATENT AND TRADEMARK OFFICE

CERTIFICATE OF CORRECTION

PATENT NO. : 5,123,311

DATED : June 23, 1992

INVENTOR(S) : Andrew C. Dymek

It is certified that error appears in the above-identified patent and that said Letters Patent is hereby corrected as shown below:

Column 1, line 68, after "driven, insert a period (.).

Column 3, line 36, after "axis" (first occurrence), delete the remainder of line 36 and insert --of cylinder 26 to the longitudinal axis of the first--.

Column 4, line 19, after "smaller" insert a period (.).

Column 4, line 29, after "adjusted" insert a period (.).

Column 4, line 44, after "member" insert --111.--.

Column 6, lines 33-34 (Claim 9), delete "having adapted to be" and insert --being--.

Column 6, line 37 (Claim 9), after "member" insert --and--.

Column 8, line 12 (Claim 14), after "shoulder" insert a period (.).

Signed and Sealed this

Thirty-first Day of August, 1993

Bruce Lehman

*Attest:*

BRUCE LEHMAN

*Attesting Officer*

*Commissioner of Patents and Trademarks*